US009869506B2

(12) United States Patent
Hanson et al.

(10) Patent No.: US 9,869,506 B2
(45) Date of Patent: Jan. 16, 2018

(54) DRAWER SYSTEM INCLUDING COVER

(71) Applicant: Electrolux Home Products, Inc., Charlotte, NC (US)

(72) Inventors: Joshua Hanson, Charlotte, NC (US); Benjamin Paul Shrader, Charlotte, NC (US); Saba Rizzi, Charlotte, NC (US); Nathan Cho, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/157,546

(22) Filed: May 18, 2016

(65) Prior Publication Data

US 2016/0341469 A1 Nov. 24, 2016

Related U.S. Application Data

(60) Provisional application No. 62/162,919, filed on May 18, 2015.

(51) Int. Cl.
*F25D 25/00* (2006.01)
*F25D 25/02* (2006.01)
*F25D 23/06* (2006.01)

(52) U.S. Cl.
CPC ..... *F25D 25/025* (2013.01); *F25D 23/062* (2013.01); *A47B 2210/08* (2013.01);
(Continued)

(58) Field of Classification Search
CPC ..... F25D 23/02; F25D 23/062; F25D 25/021; F25D 25/025
(Continued)

(56) References Cited

U.S. PATENT DOCUMENTS 2,246,342 A * 6/1941 Brown ..... F25D 25/025 126/340
3,295,904 A * 1/1967 Cobb ..... A47B 88/0407 312/270.3

(Continued)

FOREIGN PATENT DOCUMENTS

| | | | |
|---|---|---|---|
| CN | 103851871 | A | 6/2014 |
| JP | 2004 309016 | A | 11/2004 |
| KR | 2006-0112069 | A | 10/2006 |

OTHER PUBLICATIONS

International Search Report and Written Opinion from Corresponding Application No. PCT/US2016/032995; dated Jul. 27, 2016.

*Primary Examiner* — James O Hansen
(74) *Attorney, Agent, or Firm* — Pearne & Gordon LLP

(57) ABSTRACT

A drawer system includes a drawer and a drawer cover. The drawer can include an open top and be configured to be supported at a supporting structure, such as a refrigerator fresh food compartment for example, for selective sliding movement outwardly from the supporting structure and sliding movement inwardly toward the supporting structure. The drawer cover can be configured to be mounted at the supporting structure in engagement with the drawer at the open top of the drawer for movement directly vertically upwardly at the supporting structure away from the open top of the drawer when the drawer is moved outwardly from the supporting structure and for movement directly vertically downwardly at the supporting structure toward the open top of the drawer when the drawer is moved inwardly toward the supporting structure.

15 Claims, 4 Drawing Sheets

(52) U.S. Cl.
CPC .... *A47B 2210/175* (2013.01); *F25D 2323/02* (2013.01); *F25D 2325/00* (2013.01)

(58) Field of Classification Search
USPC ..... 312/401, 402, 404; 62/382
See application file for complete search history.

(56) References Cited

U.S. PATENT DOCUMENTS

| | | | | | |
|---|---|---|---|---|---|
| 4,732,435 | A | * | 3/1988 | Bailey | F25D 25/024 312/274 |
| 4,874,209 | A | * | 10/1989 | Spitzer | A47B 88/02 16/29 |
| 5,641,217 | A | | 6/1997 | Caruso et al. | |
| 6,834,922 | B2 | | 12/2004 | Cho | |
| 7,350,886 | B2 | | 4/2008 | Antos et al. | |
| 8,408,666 | B2 | | 4/2013 | Armstrong et al. | |
| 8,590,993 | B2 | | 11/2013 | Lee et al. | |
| 8,684,478 | B2 | | 4/2014 | Park et al. | |
| 2003/0201700 | A1 | | 10/2003 | Cho | |
| 2012/0273504 | A1 | | 11/2012 | Rackley et al. | |
| 2013/0300276 | A1 | | 11/2013 | Nuss | |

* cited by examiner

DRAWER SYSTEM INCLUDING COVER

CROSS-REFERENCE TO RELATED APPLICATIONS

Benefit of U.S. Provisional Patent Application Ser. No. 62/162,919, filed May 18, 2015, is hereby claimed and the disclosure incorporated herein by reference.

FIELD OF THE INVENTION

The present invention relates generally to drawer systems and, more particularly, to drawer systems that include drawers and covers or lids for the drawers that are raised and lowered from and to the drawers when the drawers are withdrawn from and returned, respectively, to the supports at which the drawers are held.

BACKGROUND OF THE INVENTION

Drawers that are provided for various applications, such as crisper drawers that are provided for refrigerated appliances for example, typically include open tops such that air is able to circulate within the interiors of the drawers. It can be preferable, for certain applications, that the drawers be provided with covers or lids that close off the open tops of the drawers even to the point of sealing the interiors of the drawers to the surrounding environment when the drawers are at rest at the supporting structures. For example, in the case of crisper drawers, lids or covers, by closing off the open tops, and sealing off the interiors, of the crisper drawers would minimize air circulation within the interiors of the crisper drawers and, thereby, allow the humidity within the crisper drawers to be controlled.

BRIEF SUMMARY OF THE INVENTION

The following presents a simplified summary of the invention in order to provide a basic understanding of some aspects of the invention. The summary does not represent an extensive overview of invention, nor is the summary intended to identify key or critical elements of the invention or delineate the scope of the invention. The sole purpose of the summary is to present certain concepts of the invention in a simplified form as a prelude to the description of the invention that is presented hereinafter.

According to one aspect, a drawer system can include a drawer that has an open top and is configured to be supported at a supporting structure, such as, for example, the interior structure of the fresh food compartment of a refrigerator, for sliding movement of the drawer outwardly from the supporting structure and subsequent sliding movement of the drawer inwardly from the exterior of the supporting structure toward the supporting structure. The drawer system also can include a drawer cover that is configured to be mounted at the supporting structure in engagement with the drawer at the open top of the drawer for movement directly vertically upwardly at the supporting structure away from the open top of the drawer when the drawer is moved outwardly from the supporting structure and movement directly vertically downwardly at the supporting structure toward the open top of the drawer, thereby selectively closing the open top of the drawer when the drawer is moved inwardly toward the supporting structure.

According to another aspect, the drawer can include at least one drawer cover engaging component and the drawer cover can include at least one drawer engaging component in engagement with a one of the at least one drawer cover engaging component.

According to a further aspect, the at least one drawer cover engaging component can include a first portion and a second portion that are substantially coplanar. An intermediate portion of the at least one drawer cover engaging component can join the first portion and the second portion and be located further from the drawer cover than the first portion and the second portion.

According to an additional aspect, the at least one drawer engaging component can be rotatable along the first portion and the intermediate portion of one of the at least one drawer cover engaging component when the drawer is moved outwardly from the supporting structure and when the drawer is moved inwardly toward the supporting structure.

According to yet another aspect, the at least one drawer engaging component can comprise a wheel that is mounted for rotation at the drawer cover.

According to yet a further aspect, the drawer can includes a front end and a rear end and the first portion of the drawer cover engaging component can be located nearer the rear end of the drawer than the front end of the drawer. The drawer engaging component can be located at the first portion of the drawer cover engaging component when the drawer is located outwardly of the supporting structure, and the drawer engaging component can be located at the intermediate portion of the drawer cover engaging component when the drawer is located at the supporting structure.

According to yet an additional aspect, the supporting structure can comprise a refrigerator, including the fresh food compartment of a refrigerator, or a supporting structure within a refrigerator, whereby the movement of the drawer outwardly and inwardly of the supporting structure comprises the movement of the drawer from the interior to the exterior of the refrigerator and from the exterior to the interior of the refrigerator.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
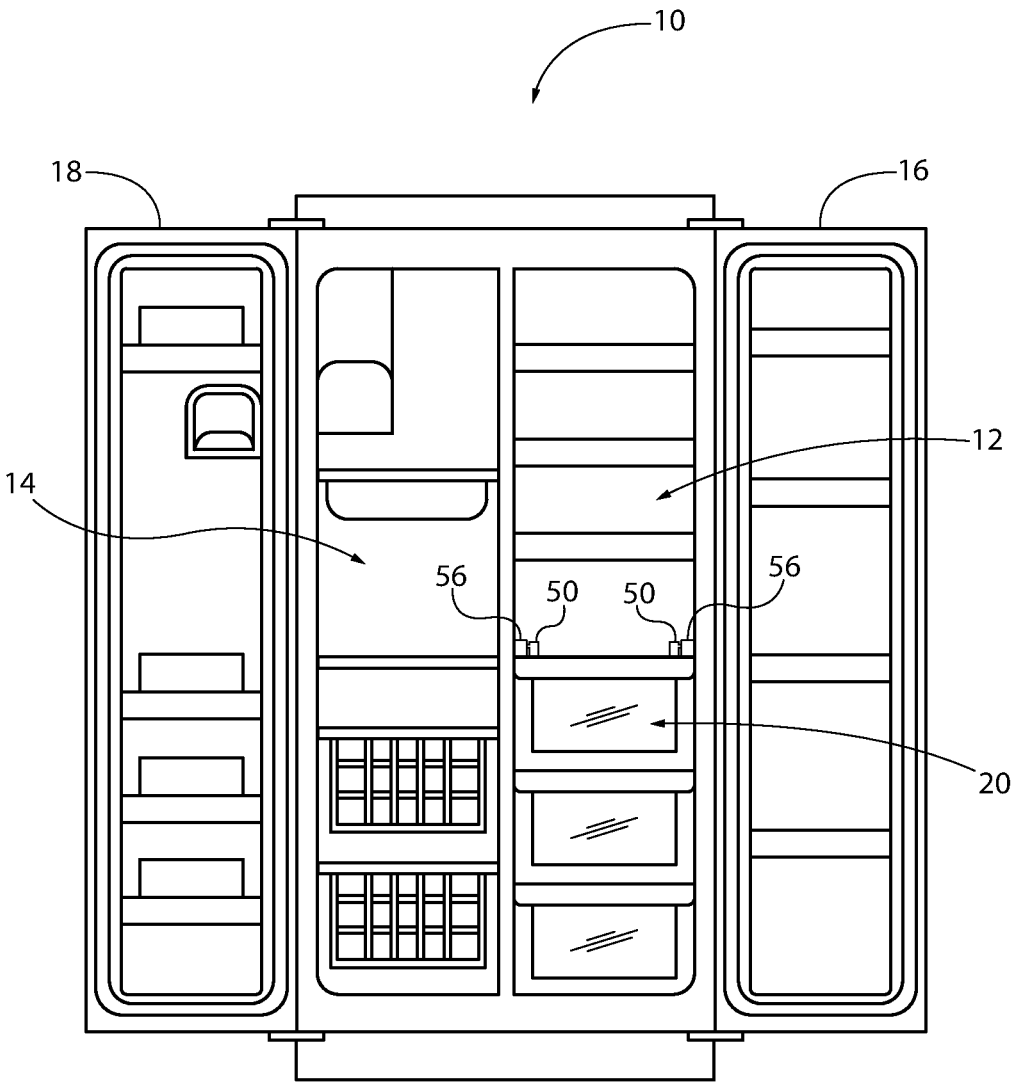
FIG. 1 is a somewhat schematic elevated front view of an embodiment of the invention, wherein an example of a drawer assembly according to the invention is shown incorporated at a refrigeration appliance.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

The present invention concerns a drawer system comprising a drawer and a drawer cover that can be supported at any supporting structure that allows for the lifting of the drawer cover from the drawer upon the withdrawal of the drawer from the supporting structure and the subsequent lowering of the drawer cover at the drawer upon the return of the drawer to the supporting structure. The supporting structure can comprise, for example, a cabinet, closet or cupboard per se, such as a refrigerator for example, or an independent supporting structure that is provided at the interior of the cabinet, closet or cupboard.

Referring to FIG. 1, there is illustrated an example embodiment of the present invention comprising a refrigerator, indicated generally at 10, that includes at least one refrigerated compartment having a refrigerated compartment interior at which a drawer system in accordance with the invention, and indicated generally at 20, is in place. In the embodiment of FIG. 1, the refrigerator 10 comprises a conventional side-by-side household refrigerator that includes two refrigerated compartments—a fresh food compartment having a fresh food compartment interior, indicated generally at 12, and a freezer compartment having a freezer compartment interior, indicated generally at 14. A first closure, comprising door 16, is provided to selectively close off and open access to the fresh food compartment interior 12, and a second closure, comprising door 18, is provided to selectively close off and open access to the freezer compartment interior 14. The refrigerator 10 can include the typical kinds of storage units comprising drawers, baskets and shelves for example that are conventionally provided in household refrigerators as indicated schematically in the example embodiment of FIG. 1 and as will be understood by those having ordinary skill in the art. Also as will be familiar to those having ordinary skill in the art, the drawers and baskets, as well as the drawer system 20, can be mounted within the interior of the refrigerator 10 in a manner so that they can be withdrawn from and returned to the interior of the refrigerator by a sliding motion on glides or the like.

The example of the drawer system 20 of the invention is shown to be located in the fresh food compartment interior 12, but the drawer system also can be located in the freezer compartment interior 14 alone or together with drawer systems 20 located in the fresh food compartment interior. Additionally more than one drawer system 20 can be located in each or both of the fresh food compartment interior 12 and the freezer compartment interior 14. Further, the drawer system of the invention can be provided in other types of refrigerators such as, for example, so-called top-mount and bottom-mount refrigerators, refrigerators that include only a fresh food compartment, upright freezers and in commercial refrigeration appliances. The drawer system of the invention also can be provided in cabinets, closets and cupboards that do not include a refrigerating function and may or may not provide for the storage of foodstuffs.

Figure 2:
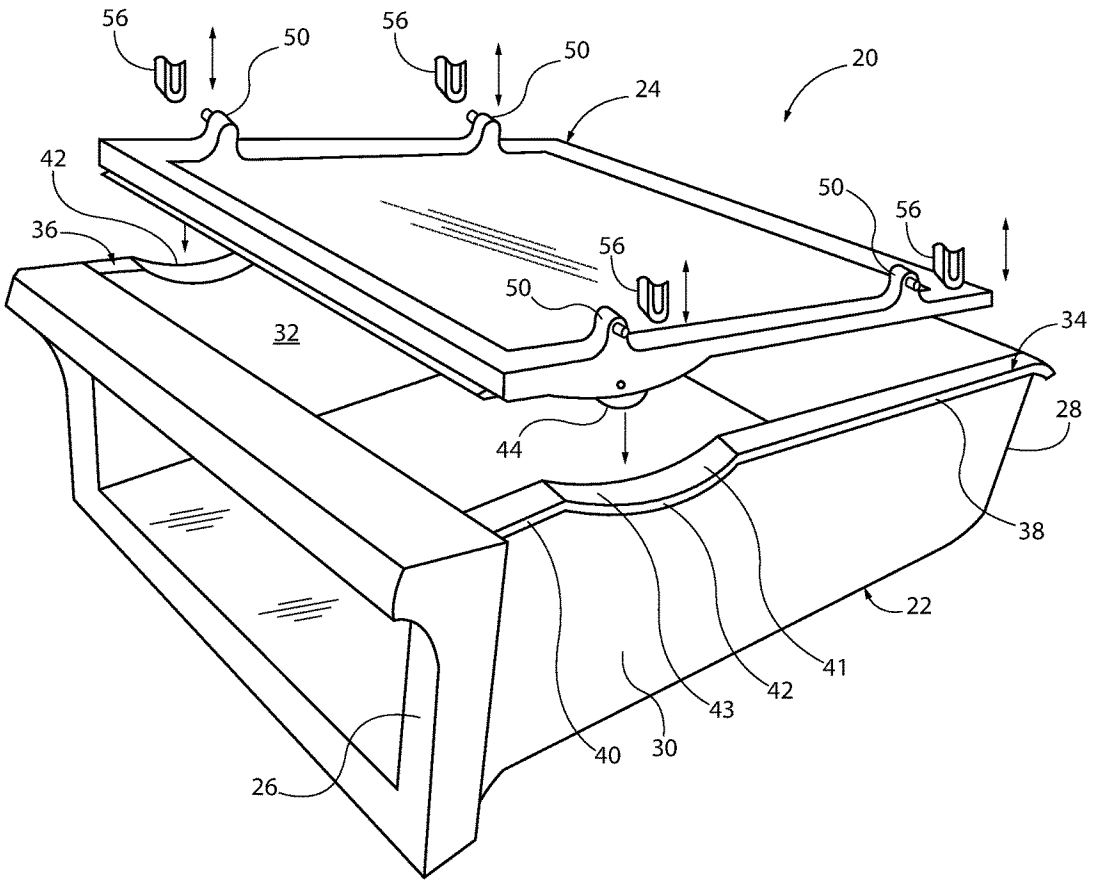
FIG. 2 is an exploded perspective view of an example of a drawer system in accordance with the invention.

The drawer system 20 of the invention, as can be seen in greater detail in FIG. 2, includes a drawer, indicated generally at 22, and a drawer cover, indicated generally at 24. The drawer 22 includes an open top, a front end 26, a rear end 28, a first side 30 and a second side 32; and the drawer cover 24 is configured to be in engagement with the drawer 22 at the open top of the drawer 22 when the drawer is at rest within the fresh food compartment interior 12 and to be raised from the open top of the drawer 22 as the drawer is withdrawn from the fresh food compartment interior 12.

The refrigerator 10, and more specifically, the interior liners of the refrigerator that typically define the fresh food compartment interior 12 and the freezer compartment interior 14, can comprise supporting structures for the drawer 22 and the drawer cover 24. The drawer 22 can be configured to be supported at these supporting structures for selective sliding movement outwardly from the interior of the refrigerator toward the exterior of the refrigerator and sliding movement inwardly from the exterior of the refrigerator toward the interior of the refrigerator employing drawer hardware such as slides and glides, for example, as is familiar to those having ordinary skill in the art. Alternatively, supporting structures separate from the interior liners of the fresh food compartment interior 12 and the freezer compartment interior 14 can be provided at the interiors of those compartments and the drawer 22 and drawer cover 24 supported at the separate supporting structures employing drawer hardware familiar to persons ordinarily skilled in the art.

The drawer cover 24 is configured to be mounted at the supporting structure of the refrigerator 10 in engagement with the drawer 22 at the open top of the drawer 22; and, as described in greater detail below, the drawer cover 24 is configured to be mounted for movement directly vertically upwardly at the supporting structure of the refrigerator 10 away from the open top of the drawer 22 when the drawer 22 is moved outwardly from the interior of the refrigerator toward the exterior of the refrigerator. Correlatively, the drawer cover 24 is configured to be mounted for movement directly vertically downwardly at the supporting structure of the refrigerator 10 toward the open top of the drawer 22 so as to close off the open top of the drawer when the drawer is moved inwardly from the exterior of the refrigerator toward and into the interior of the supporting structure. Thus, it will be understood that the invention provides for a drawer system that includes a drawer including an open top, the drawer configured to be supported at a supporting structure for sliding movement outwardly from the supporting structure and subsequent sliding movement inwardly toward the supporting structure. The drawer system also includes a drawer cover that is configured to be mounted at the supporting structure in engagement with the drawer at the open top of the drawer for movement directly vertically upwardly at the supporting structure away from the open top of the drawer when the drawer is moved outwardly from the supporting structure and movement directly vertically downwardly at the supporting structure toward the open top of the drawer when the drawer is moved inwardly toward supporting structure. The movements of the drawer cover 24 directly vertically upwardly and directly vertically downwardly are accomplished without essentially any movement of the cover forwardly or rearwardly of its mounting position at the support structure.

The details of the construct of each of the drawer 22 and the drawer cover 24 that cause the drawer cover 24 to be moved away from the open top of the drawer 22 directly vertically upwardly when the drawer is withdrawn from the refrigerator interior and to be moved toward the open top of the drawer 22 directly vertically downwardly when the drawer is returned to the refrigerator interior will now be described with reference to FIGS. 2-5.

Figure 3:
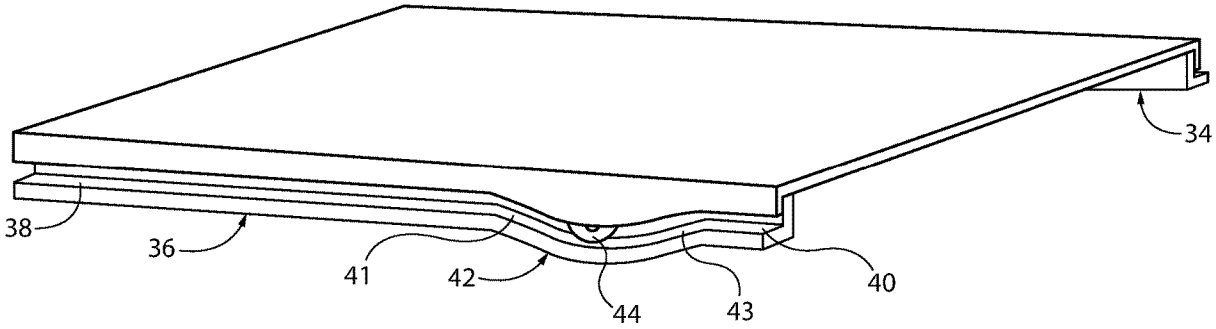
FIG. 3 is a perspective view of examples of certain components of a drawer system in accordance with the invention illustrated in a first operational condition.
Figure 4:
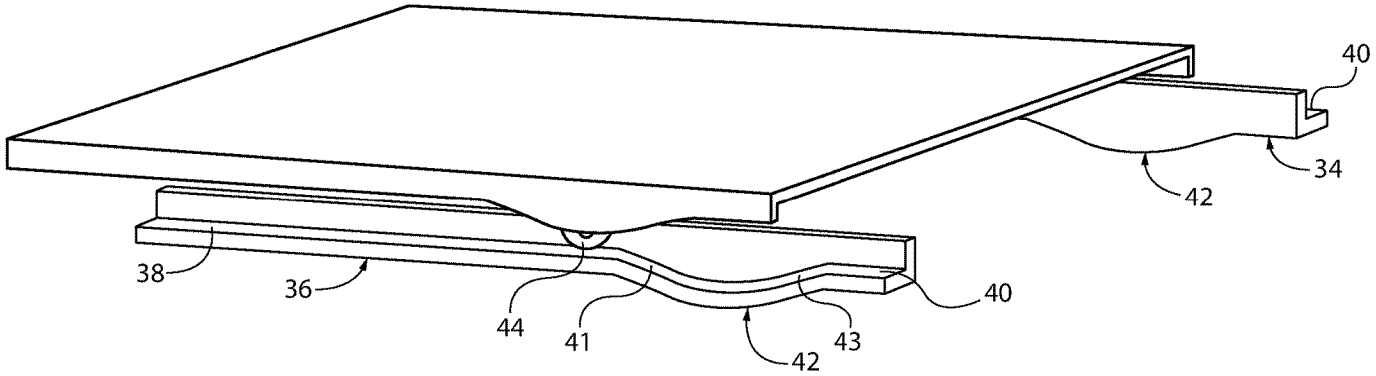
FIG. 4 is a perspective view of the examples of the components of the drawer system of FIG. 3 in a second operational condition.

With respect to the drawer 22, the drawer includes at least one drawer cover engaging component. In the example embodiment, two drawer cover engaging components are provided. Specifically, one drawer cover engaging component in the form of a first rail, indicated generally at 34, is provided at the top edge of the first side 30 of the drawer 22 and another drawer cover engaging component in the form of a second rail, indicated generally at 36, is provided at the top edge of the second side 32 of the drawer 22. FIG. 3 and FIG. 4 represent simplified depictions of the drawer cover 24 and the first rail 34 and the second rail 36, primarily for the purpose of illustrating more clearly the interrelationships between the drawer cover and the rails when the drawer 22 is at rest within the fresh food compartment interior 12 and when it is withdrawn from the fresh food compartment interior 12 as described below.

Each of the first rail 34 and the second rail 36 includes a first portion 38 and a second portion 40 that are substantially coplanar and an intermediate portion 42 that joins the first portion 38 and the second portion 40. Each first portion 38 of the first rail 34 and the second rail 36 of the drawer 22 is located nearer the rear end 28 of the drawer 22 than the front end 26 of the drawer 22, and, correlatively, each second portion 40 is located nearer the front end 26 of the drawer 22 than the rear end 28 of the drawer 22. The intermediate portion 42 of each of the first rail 34 and the second rail 36 includes a first ramp 41 that is inclined downwardly from the first portion 38 in the direction of the second portion 40 and a second ramp 43 that is inclined downwardly from the second portion 40 in the direction of the first portion 38. Each first ramp 41 and a respective second ramp 43 meet in a smooth transition to form a respective depression in each first rail 34 and second rail 36 at the intermediate portion 42 of each of the first rail 34 and second rail 36.

The drawer cover 24 includes at least one drawer engaging component that is in engagement with a respective one of the at least one drawer cover-engaging component. Specifically, in the example embodiment shown in the drawings, a drawer engaging component in the form of a respective rotatable wheel 44 is mounted for rotation at each side edge of the drawer cover 24. As illustrated in the example embodiment, the rotatable wheels 44 are located at the sides of the drawer cover 24 so that respective rotatable wheels 44 engage the first rail 34 and the second rail 36 of the drawer 22. The drawer engaging component need not comprise a rotatable element such as the rotatable wheel 44, however, but can comprise any type of a projection that extends below the bottom of the drawer cover 24 and causes the drawer cover to be raised and lowered as each projection moves along a respective one of the first rail 34 and the second rail 36 as the drawer 22 is opened and closed as described below. For example, the projection can comprise a low-friction element such as a plastic projection or a cloth-covered projection.

Figure 5:
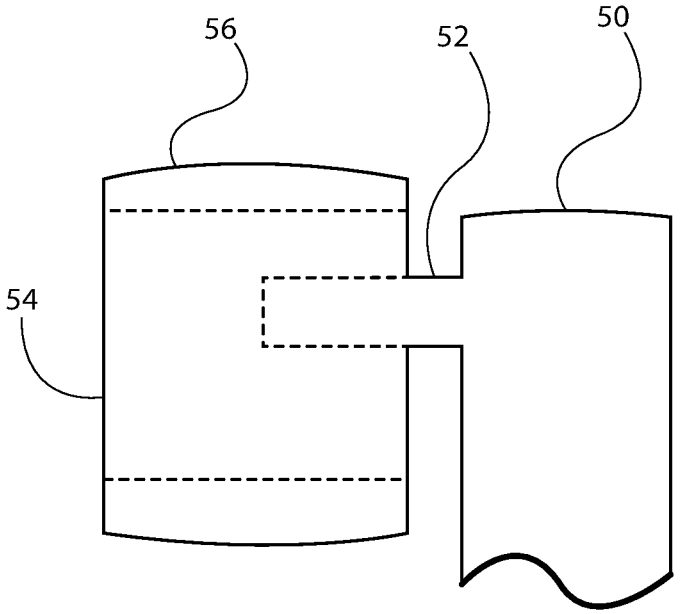
FIG. 5 is a somewhat schematic elevated front view of an example of a component of a drawer cover that comprises a part of the drawer assembly of the invention.

Arranged at the upper surface of the drawer cover 24 at each side of the drawer cover are two spaced-apart hangers 50, shown in FIG. 2 and in detail in FIG. 5, but omitted from FIGS. 3 and 4, that allow the drawer cover 24 to be raised directly vertically upwardly away from the open top of the drawer 22 when the drawer is moved outwardly from the interior of the refrigerator 10 and lowered directly vertically downwardly toward the open top of the drawer when the drawer 22 is moved inwardly from the exterior of the refrigerator 10 toward the interior of the refrigerator.

As shown in FIG. 5, each hanger 50 includes a pin 52 that extends outwardly from the hanger in the direction of an adjacent side of the fresh food compartment interior 12. A respective anchor 56 for each hanger 50 is mounted to or within a side wall of the fresh food compartment interior 12. Each anchor 56 includes a slot 54 that receives the pin 52 of a respective hanger 50, thereby supporting the drawer cover 24 in place for vertical upward and downward movement in relation to the open top of the drawer 22.

Based on the foregoing description, and with reference to FIG. 2 through FIG. 5, it will be understood that the drawer engaging components, comprising the wheels 44, are located at the depressions at the intermediate portions 42 of the drawer cover engaging portions, comprising the first rail 34 and the second rail 36, when the drawer 22 is in place at rest within the fresh food compartment interior 12 of the refrigerator 10, as indicated in FIG. 3. Conversely, as shown in FIG. 4, when the drawer 22 is located outwardly of the refrigerator 10, as indicated by the displacement of the first rail 34 and the second rail 36 longitudinally from the drawer cover 24, the drawer engaging components of the drawer cover 24, comprising the wheels 44, are located at the first portion 38 of each of the drawer cover engaging components, comprising the first rail 34 and the second rail 36 of the drawer 22. Thus, the at least one drawer engaging component of the drawer cover 24, comprising the wheels 44, are rotatable along the first portion 38 and intermediate portion 42 of a respective at least one drawer cover engaging component, comprising the first rail 34 and the second rail 36, when the drawer 22 is moved outwardly from the interior of the refrigerator 10 toward the exterior of the refrigerator and when the drawer 22 is moved inwardly from the exterior of the refrigerator 10 toward the interior of the refrigerator.

The wheels 44 extend below the bottom surface of the drawer cover 24 the same distance that a lowest point in each of the depressions formed at the intermediate portions 42 of the first rail 34 and the second rail 36 lies below the first portions 38 and second portions 40 of the first rail 34 and the second rail 36. Thus, it can be understood, that when the wheels 44 reside at the bottoms of the depressions formed at the intermediate portions 42 of the first rail 34 and the second rail 36, the drawer cover 24 will close off the open top of the drawer 22, and, as the drawer 22 is pulled outwardly, the wheels 44 will ride up along the first ramps 41 that lead to the first portions 38 of the first rail 34 and the second rail 36, respectively, and onto the first portions 38, causing the drawer cover 24, confined by the movement of the pins 52 in respective slots 54 of respective anchors 56, to move directly vertically upwardly away from the open top of the drawer 22. Conversely, when the drawer 22 is moved from the exterior of the refrigerator 10 inwardly to the interior of the refrigerator 10, the wheels 44 will ride along respective first portions of respective ones of the first rail 34 and the second rail 36 and down the first ramps 41 of respective intermediate portions 42 of the rails until the wheels come to rest at the lowest points of the depressions at the intermediate portions 42, thereby causing the drawer cover 24, again confined by the movement of the pins 52 in the slots 54 of the anchors 56, to move directly vertically downwardly and close off the open top of the drawer 22. Once the wheels 44 reach the first ramps 41 of the intermediate portions 42, the drawer is able to move further inwardly of the refrigerator interior to a fully closed position under the influence of gravity. In this connection each of the first portions 38 of the first rail 34 and the second rail 36 can be inclined upwardly somewhat from the respective intermediate portions 42 of the rails towards the ends of the first portions 38 located at the rear end 28 of the drawer 22 so that the drawer 22 can move inwardly of the refrigerator to a final resting location entirely by the influence of gravity.

As used herein, the expression "closing off of the open top of the drawer" is intended to mean both the condition in which the drawer cover 24 simply overlays the open top of the drawer 22 without sealing off the interior of the drawer 22 to the surrounding environment as well as the condition in which the drawer cover 24 seals off the interior of the drawer 22. The sealing off of the interior of the drawer 22 from the environment can be accomplished, for example, by providing a flexible seal at the underside of the drawer cover 24, the seal being located so that it comes into sealing engagement with the surfaces of the drawer 22 at those locations at which the drawer 22 and the drawer cover 24 are in contact when the drawer is at rest within the interior of the refrigerator 10.

The invention has been described herein above using specific examples; however, it will be understood by those skilled in the art that various alternatives may be used and equivalents may be substituted for elements or steps described herein without deviating from the scope of the invention. Modifications may be necessary to adapt the invention to a particular situation or to a particular need without departing from the scope of the invention. It is intended that the invention not be limited to the particular implementation described herein, but that the claims be given their broadest interpretation to cover all embodiments, literal or equivalent, covered thereby.

What is claimed is:

1. A drawer system including:

a drawer including an open top, the drawer configured to be supported at a supporting structure for sliding movement outwardly from the supporting structure and subsequent sliding movement inwardly toward the supporting structure; and a drawer cover configured to be mounted at the supporting structure in engagement with the drawer at the open top of the drawer for movement directly vertically upwardly at the supporting structure away from the open top of the drawer when the drawer is moved outwardly from the supporting structure and movement directly vertically downwardly at the supporting structure toward the open top of the drawer when the drawer is moved inwardly toward the supporting structure, wherein the supporting structure includes at least one hanger at the drawer cover that supports the drawer cover from a fixed anchor, and wherein the at least one hanger includes a pin that is received in a vertical slot in the fixed anchor, thereby limiting the drawer cover to movement directly vertically upwardly at the fixed anchor away from the open top of the drawer when the drawer is moved outwardly from the fixed anchor and movement directly vertically downwardly at the fixed anchor toward the open top of the drawer when the drawer is moved inwardly toward the fixed anchor.

2. The drawer system of claim 1 wherein the drawer includes at least one drawer cover engaging component and the drawer cover includes at least one drawer engaging component in engagement with a one of the at least one drawer cover engaging component.

3. The drawer system of claim 2 wherein the at least one drawer cover engaging component includes a first portion, a second portion that is substantially coplanar with the first portion and an intermediate portion that joins the first portion and the second portion and is located further from the drawer cover than the first portion and the second portion.

4. The drawer system of claim 3 wherein the at least one drawer engaging component is rotatable along the first portion and intermediate portion of one of the at least one drawer cover engaging component when the drawer is moved outwardly from the supporting structure and when the drawer is moved inwardly toward the supporting structure.

5. The drawer system of claim 4 wherein the at least one drawer engaging component comprises a wheel that is mounted for rotation at the drawer cover.

6. The drawer system of claim 4 wherein the drawer includes a front end and a rear end, the first portion of the drawer cover engaging component is located nearer the rear end of the drawer than the front end of the drawer, the drawer engaging component is located at the first portion of the drawer cover engaging component when the drawer is located outwardly of the supporting structure and the drawer engaging component is located at the intermediate portion of the drawer cover engaging component when the drawer is located at the supporting structure.

7. The drawer system of claim 1 wherein the supporting structure comprises a refrigerator cabinet.

8. The drawer system of claim 1 wherein the drawer cover includes two hangers at each of two sides of the drawer cover.

9. A refrigerator that includes a fresh food compartment and a drawer system supported at the fresh food compartment, the drawer system comprising:

a drawer including an open top, the drawer configured to be supported at the fresh food compartment for selective sliding movement outwardly from an interior of the fresh food compartment toward an exterior of the fresh food compartment and sliding movement inwardly from the exterior of the fresh food compartment toward the interior of the fresh food compartment; and a drawer cover configured to be mounted at the interior of the fresh food compartment in engagement with the drawer at the open top of the drawer for movement directly vertically upwardly within the fresh food compartment away from the open top of the drawer when the drawer is moved outwardly from the interior of the fresh food compartment toward the exterior of the fresh food compartment and movement directly vertically downwardly within the fresh food compartment toward the open top of the drawer when the drawer is moved inwardly from the exterior of the fresh food compartment toward the interior of the fresh food compartment, wherein the drawer cover includes at least one hanger that supports the drawer cover from an anchor mounted to a side wall of the fresh food compartment, and wherein the at least one hanger includes a pin that is received in a vertical slot in the anchor, thereby limiting the drawer cover to movement directly vertically upwardly at the anchor within the fresh food compartment away from the open top of the drawer when the drawer is moved outwardly from the fresh food compartment and movement directly vertically downwardly at the anchor toward the open top of the drawer when the drawer is moved inwardly of the fresh food compartment.

10. The drawer system of claim 9 wherein the drawer includes at least one drawer cover engaging component and the drawer cover includes at least one drawer engaging component in engagement with a one of the at least one drawer cover engaging component.

11. The drawer system of claim 10 wherein the at least one drawer cover engaging component includes a first portion, a second portion that is substantially coplanar with the first portion and an intermediate portion that joins the first portion and the second portion and is located further from the drawer cover than the first portion and the second portion.

12. The drawer system of claim 11 wherein the at least one drawer engaging component is rotatable along the first portion and intermediate portion of one of the at least one drawer cover engaging component when the drawer is moved outwardly from the interior of the fresh food compartment toward the exterior of the fresh food compartment and when the drawer is moved inwardly from the exterior of the fresh food compartment toward the interior of the fresh food compartment.

13. The drawer system of claim 12 wherein the at least one drawer engaging component comprises a wheel that is mounted for rotation at the drawer cover.

14. The drawer system of claim 12 wherein the drawer includes a front end and a rear end, the first portion of the drawer cover engaging component is located nearer the rear end of the drawer than the front end of the drawer, the drawer engaging component is located at the first portion of the drawer cover engaging component when the drawer is located at the exterior of the fresh food compartment and the drawer engaging component is located at the intermediate portion of the drawer cover engaging component when the drawer is located at the interior of the fresh food compartment.

15. The drawer system of claim 9 wherein the drawer cover includes two hangers at each of two sides of the drawer cover.

* * * * *